US008228136B2

(12) United States Patent
Subedi

(10) Patent No.: US 8,228,136 B2
(45) Date of Patent: Jul. 24, 2012

(54) MICRO P-COUPLER

(75) Inventor: Purna C. Subedi, Irvine, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 235 days.

(21) Appl. No.: 12/660,629

(22) Filed: Mar. 2, 2010

(65) Prior Publication Data

US 2010/0225415 A1 Sep. 9, 2010

Related U.S. Application Data

(60) Provisional application No. 61/157,873, filed on Mar. 5, 2009.

(51) Int. Cl.
*H01P 5/12* (2006.01)
*H01P 1/06* (2006.01)

(52) U.S. Cl. ..... 333/111; 333/116; 333/261

(58) Field of Classification Search ..... 333/109, 333/111, 112, 116, 261
See application file for complete search history.

(56) References Cited

U.S. PATENT DOCUMENTS 4,476,447 A * 10/1984 Lauchner ..... 333/111
6,624,722 B2 * 9/2003 Wang et al. ..... 333/116

OTHER PUBLICATIONS

J.A.G. Malherbe, "Microwave Transmission Line Couplers", Artech House, 1988, pp. 82-134.
D.M. Pozar, "Microwave Engineering", Addison-Wesley Publishing Company, 1993, pp. 415-427.
G. L. Matthaei, L. Young and E.M.T. Jones, "Microwave Filters, Impedance-Matching Networks and Coupling Structures", Artech House Dedham, MA 1964, pp. 775-797.
Joe Nicewicz, "Directional Coupler Techniques", Filtronic Engineering Conference 1999, pp. 1-2.
Purna Subedi, "The Barrel Coupler", Filtronic Engineering Conference 2000, pp. 1-12.
Purna Subedi, "The P-Coupler", 2002, pp. 1-14.

* cited by examiner

*Primary Examiner* — Dean O Takaoka
(74) *Attorney, Agent, or Firm* — OC Patent Law Group

(57) ABSTRACT

A coupling loop with each leg connected by two resistors, R1 and R2 going to ground on a disk shaped printed circuit board provides a directional coupler with directivity tuned by rotating this disk assembly and coupling controlled by the distance to the main RF transmission line. Once the desired level of directivity is obtained, this board is locked with screws from the top.

11 Claims, 8 Drawing Sheets

MICRO P-COUPLER

RELATED APPLICATION INFORMATION

The present application claims priority under 35 U.S.C. Section 119(e) to U.S. provisional patent application Ser. No. 61/157,873 filed Mar. 5, 2009, the disclosure of which is incorporated herein by reference in its entirety.

FIELD OF THE INVENTION

The present invention relates to microwave directional couplers and assemblies.

BACKGROUND OF THE INVENTION

Almost all the microwave filters and duplexers for high power transmitting applications require integration of directional couplers. Though the couplers are probably the simplest in terms of complexity in a filter integrated system, coupler failures have become one of the major bottlenecks in production. Coupler failures for directivity and match are the two major causes of yield problems. Though the couplers may look completely different after they are implemented to fit into a certain geometry, many of them fall in one of the following the categories: slabline, stripline, micro-stripline, coupled line, multi-hole wave guide couplers, rat race, the barrel coupler etc. Each has its own advantages, disadvantages and idiosyncrasies. A theoretical discussion of each of these coupler types can be found in many text books and papers, J. A. G. Malherbe, "Microwave Transmission Line Couplers", Artech House, 1988; D. M. Pozar, "Microwave Engineering", Addison-Wesley Publishing Company, 1993; and G. L. Matthaei, L. Young and E. M. T. Johes, Microwave Filters, Impedance-Matching Networks and Coupling Structures, Artech House Dedham, Mass. 1964. A good discussion of some of the coupler types can be found in Joe Nicewicz, "Directional Coupler Techniques", Filtronic Engineering Conference 1999 and Puma Subedi, "The Barrel Coupler", Filtronic Engineering Conference 2000.

A coupler referred to as a "P coupler" has been provided which has several advantages. The "P" coupler provides a good broadband match and the same coupler can be tuned for any band within a several GHz window. Not only the performance of the "P" coupler exceeds the performance of the Barrel Coupler (Puma Subedi, "The Barrel Coupler", Filtronic Engineering Conference 2000), the cost estimate is lower than half of the Barrel coupler. The directivity and the couplings are tunable parameters and usually 30-dB of directivity with at least 20-dB of match is easily achieved. These couplers can be tuned from upper around 10 dB to 50-dB values. The same barrel coupler that works well in all the Cellular, DCS, PCS and the UMTS bands has been developed and the results and design details are discussed in Puma Subedi, "The P-Coupler", 2002. Additionally, the P-Coupler can be used in extremely high peak power conditions unlike the Barrel Coupler where the Barrel housing can come too close to the main transmission line. In utilizing this coupler, the loss of the thru line is only the loss of an air filled coaxial line plus whatever the coupling loss is since this is an airline coupler. This coupler uses only 0.75-inches (19.05 mm) diameter of x, y real-state and the coupling direction is reversible.

Despite the advantages of the known "P" coupler design, the present applicant has discovered that non-obvious improvements can be made which have advantages for cost, manufacturability and allow smaller size and weight.

SUMMARY OF THE INVENTION

In a first aspect the present invention provides a microwave coupler assembly comprising a rotatable disk shaped circuit board having first and second major surfaces coated with conductive material, the first and second surfaces respectively having first and second regions of exposed dielectric material without conductive material thereon and a conductive coupling loop mounted to the first surface of the circuit board in the first region and oriented away from the surface. The microwave coupler assembly further comprises first and second resistors connecting the coupling loop to the first conductive surface of the circuit board and an RF connector electrically connected to the coupling loop and extending from the second surface of the circuit board in the second region.

In a preferred embodiment of the microwave coupler assembly the conductive coupling loop is generally U shaped. The circuit board preferably has first and second openings for receiving pins from a test fixture. The first and second resistors are preferably electrically connected to opposite ends of the U shaped conductive coupling loop and to the conductive first surface of the circuit board.

In another aspect the present invention provides a combined microwave test fixture and directional coupler assembly. The combined assembly comprises a directional coupler assembly including a coupler fixture housing having an input port, a through port, a coupled port, and a decoupled port, and an adjustable coupler structure mounted in a bore of the coupled port of the housing. The coupler structure comprises a conductive rotatable disk shaped circuit board, a conductive coupling loop mounted to the circuit board at a dielectric portion thereof and oriented into the bore of the housing, first and second resistors electrically connecting the coupling loop to the circuit board, a RF connector electrically connected to the coupling loop and also extending from the opposite side of the circuit board from the coupling loop and a test fixture mating connector on the circuit board. The combined assembly further comprises a test fixture assembly comprising a directivity adjustment connector adapted to mate with the test fixture mating connector on the circuit board and an RF connector adapted to mate with the RF connector on the circuit board, wherein the disk is adjustable by turning the test fixture to rotate the disk shaped circuit board and change the direction of the loop in the housing and alter the directivity of the coupling of the coupled port.

In a preferred embodiment of the combined microwave test fixture and directional coupler assembly the test fixture mating connector comprises first and second holes in the circuit board and the directivity adjustment connector of the test fixture comprises matching mating pins. The test fixture assembly preferably comprises a housing having first and second screws and threaded holes in the housing and an inner opening receiving the RF connector and the RF connector is locked in place in the housing by engaging it by the set screws. The coupler fixture housing includes an inner cavity and a through coupler is preferably configured within the cavity between the input and coupled ports. The coupled port is measurable at different loop orientations from the RF connector of the test fixture assembly. The microwave test fixture and directional coupler assembly may further comprise a second coupler structure configured in a second bore in the coupler fixture housing.

In another aspect the present invention provides a method of adjusting a microwave directional coupler assembly. The method comprises inserting a coupler assembly comprising a disk shaped circuit board, a conductive loop and RF connector in a bore in a coupler housing, rotating the disk shaped circuit board using a separate test fixture adapted to mate with the disk shaped circuit board, measuring RF power using a connector configured in the test fixture, locking the disk shaped circuit board in place using screws engaging the top edge of the circuit board and holes in the housing, and removing the test fixture.

Further features and advantages of the present invention will be appreciated from the following detailed description.

DETAILED DESCRIPTION OF THE INVENTION

Prior to describing a preferred embodiment of the invention the theory of conventional coupler operation will be briefly reviewed.

Basic Theory of Directional Couplers

Figure 1:
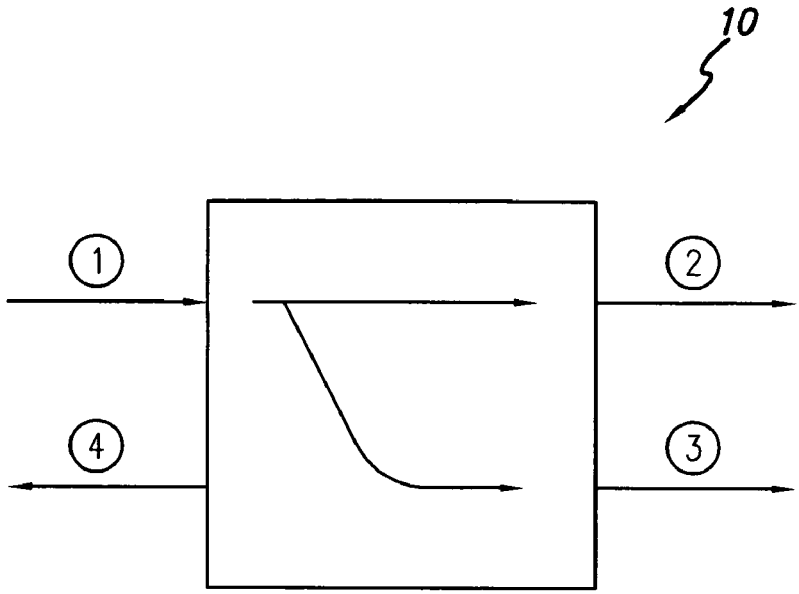
FIG. 1 is a signal flow diagram for a directional coupler.

A directional coupler is a four port network which samples a prescribed amount of power flowing in a certain direction, i.e. it performs a prescribed amount of power division or combination. The signal flow diagram for a directional coupler 10 is shown in FIG. 1. An ideal directional coupler will split power that is input in port 1 to port 2 and port 3 and no power will flow in port 4. For example, a 30-dB coupler will have power in port 3 which is 30-dB below the level of input power that is applied in port 1. The rest of the power will appear in port 2 which is the thru line insertion loss.

The scattering matrix for a reciprocal for four port network with all of the ports matched can be written as:

$$[S] = \begin{bmatrix} 0 & S_{12} & S_{13} & S_{14} \\ S_{12} & 0 & S_{23} & S_{24} \\ S_{13} & S_{23} & 0 & S_{34} \\ S_{14} & S_{24} & S_{34} & 0 \end{bmatrix} \quad (1)$$

By the definition of a directional coupler since there is no power flowing to port 4, $$S_{14}=0$$

Applying the principle of power conservation, we can write the following equations:

$$|S_{12}|^2+|S_{13}|^2=1 \quad (3)$$

$$|S_{12}|^2+|S_{24}|^2=1 \quad (4)$$

$$|S_{13}|^2+|S_{34}|^2=1 \quad (5)$$

$$|S_{24}|^2+|S_{34}|^2=1 \quad (6)$$

$$S^*_{13}S_{23}+S^*_{14}S_{24}=0 \quad (7)$$

$$S^*_{14}S_{13}+S^*_{34}S_{23}=0 \quad (8)$$

$$S^*_{12}S_{23}+S^*_{14}S_{34}=0 \quad (9)$$

$$S^*_{14}S_{12}+S^*_{34}S_{23}=0 \quad (10)$$

and by performing some algebraic manipulation, it can be shown that $$S_{14}=S_{23}=0 \quad (11)$$

It can be shown mathematically that the superposition of the waves arriving at the coupled port is added in phase and at the isolated port they are out of phase by 180°. Otherwise, the above equations can not be satisfied and we do not have a directional coupler anymore.

Some of the parameters characterizing a directional coupler are defined as follows:

$$S_{12} = -10\log\frac{P2}{P1} \quad (12)$$

$$S_{13} = -10\log\frac{P3}{P1} \quad (13)$$

$$S_{34} = -10\log\frac{P4}{P3} \quad (14)$$

$$S_{14} = -10\log\frac{P4}{P1} \quad (15)$$

where, $S_{12}$ = Insertion Loss $S_{13} = C$ = Coupling $S_{34} = D$ = Directivity $S_{14} = I$ = Isolation Directivity is a very important parameter because this parameter is the measure of how separated the forward and reverse waves are. By the above definitions, it is not easy to measure this parameter since port 4 is not easily accessible since a permanent load resistor is connected to this port. We can indirectly measure directivity by noticing that Isolation=(Coupling+Directivity) dB From Equation 11, we can see that $S_{14}=S_{23}$ and $S_{23}$ is an easily measurable parameter since the ports 2 and 3 are accessible in most of the directional couplers. We can then calculate the directivity as $$\text{Directivity} = \text{Isolation} - \text{Coupling} = -10\log\frac{P_3}{P_2} + 10\log\frac{P3}{P1} \quad (16)$$

Micro P-Coupler Principle of Operation

Figure 3:
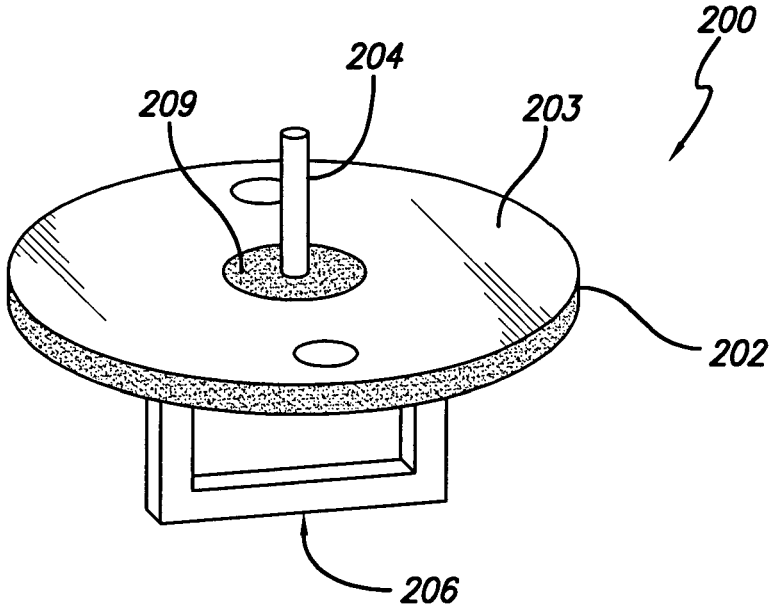
FIG. 3 is a top perspective view of the coupler assembly of the present invention in a preferred embodiment.
Figure 4:
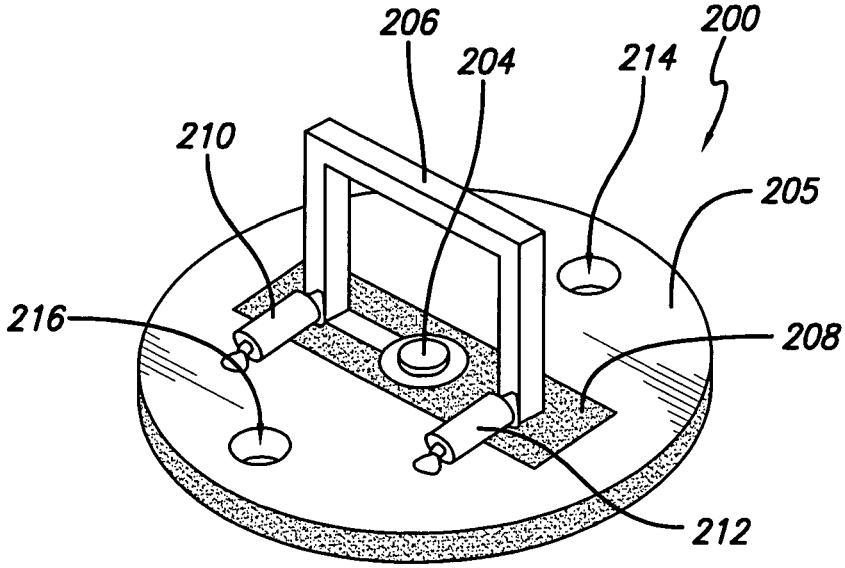
FIG. 4 is a bottom perspective view of the coupler assembly of the present invention in a preferred embodiment.

For convenient reference the coupler assembly described herein will be referred to as a micro "P" coupler since it provides an improvement on the prior "P" coupler described above, having substantially reduced size and weight as well as reduced cost and improved manufacturability. However this terminology is simply for ease of reference and not as any limitation on scope or any identification with the prior "P" coupler structure described in the background section above. The micro "P" coupler assembly is shown in FIGS. 3 and 4 in top and bottom perspective views, respectively. The micro "P" coupler assembly 200 comprises a conductive loop 206, preferably etched, stamped or formed in another inexpensive manner, that is mounted to a laminate circuit board 202. Circuit board 202 is a laminate construction having a conductive outer layer 203, 205; suitable such laminate boards include an FR-4 board as well as other laminate board types well known in the art. The laminate board is cut, stamped or otherwise trimmed to a disk shape as shown and the bottom side is etched to expose a rectangular dielectric region 208 to which the loop 206 is mounted. The match to ground is provided by resistors 210, 212, for example two 1206 surface mount resistors, which are soldered or otherwise electrically coupled to opposite ends of the loop 206 and to the conductive disk portion 205 of the board 202. The tap to the loop coupler 206 is provided via connector 204. The top side of the laminate board has a circular etched region 209 from which the connector 204 extends.

Figure 5A:
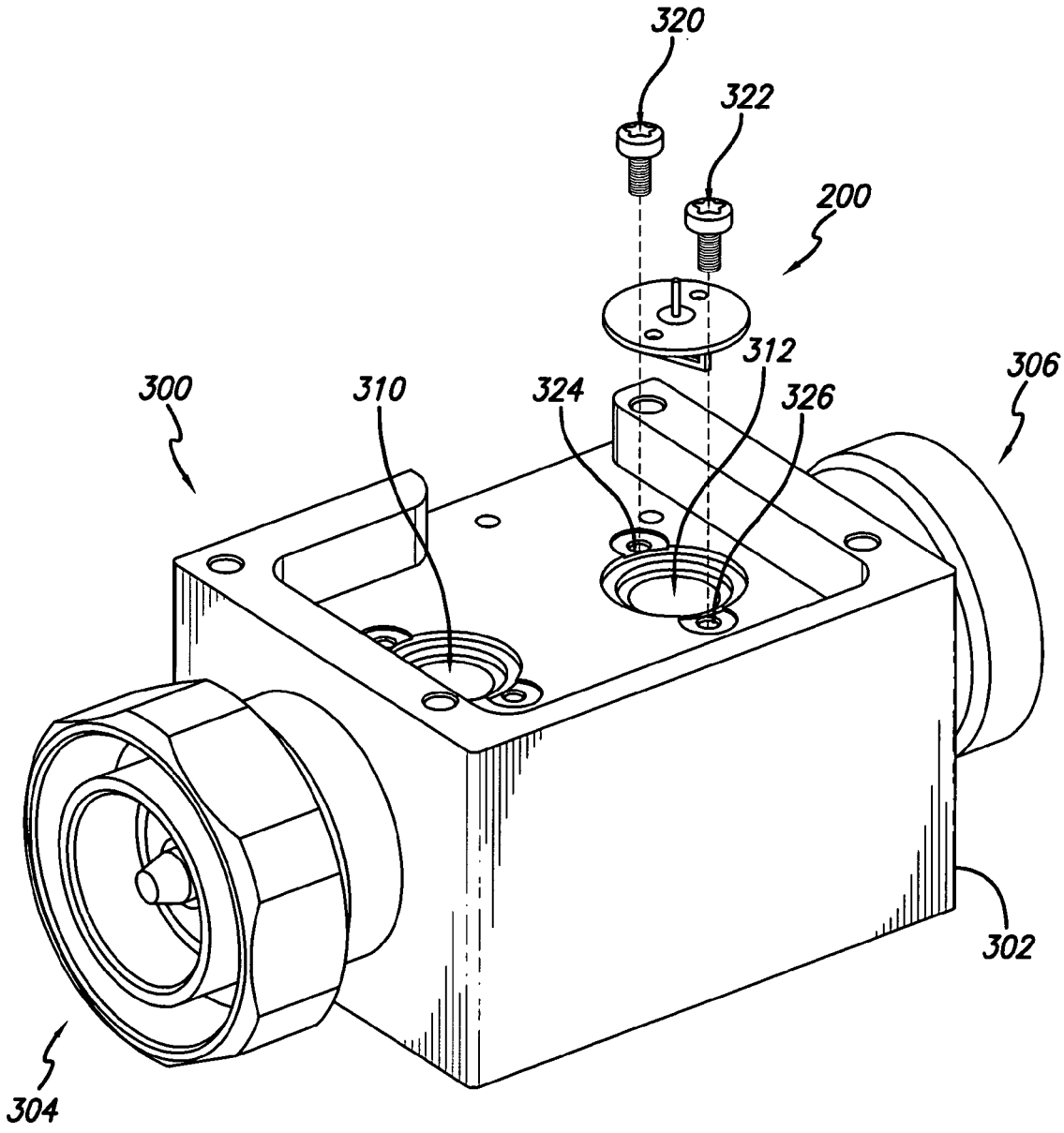
FIGS. 5A and 5B are top perspective views of the coupler assembly of the present invention being assembled in a coupler fixture in accordance with a preferred embodiment.
Figure 5B:
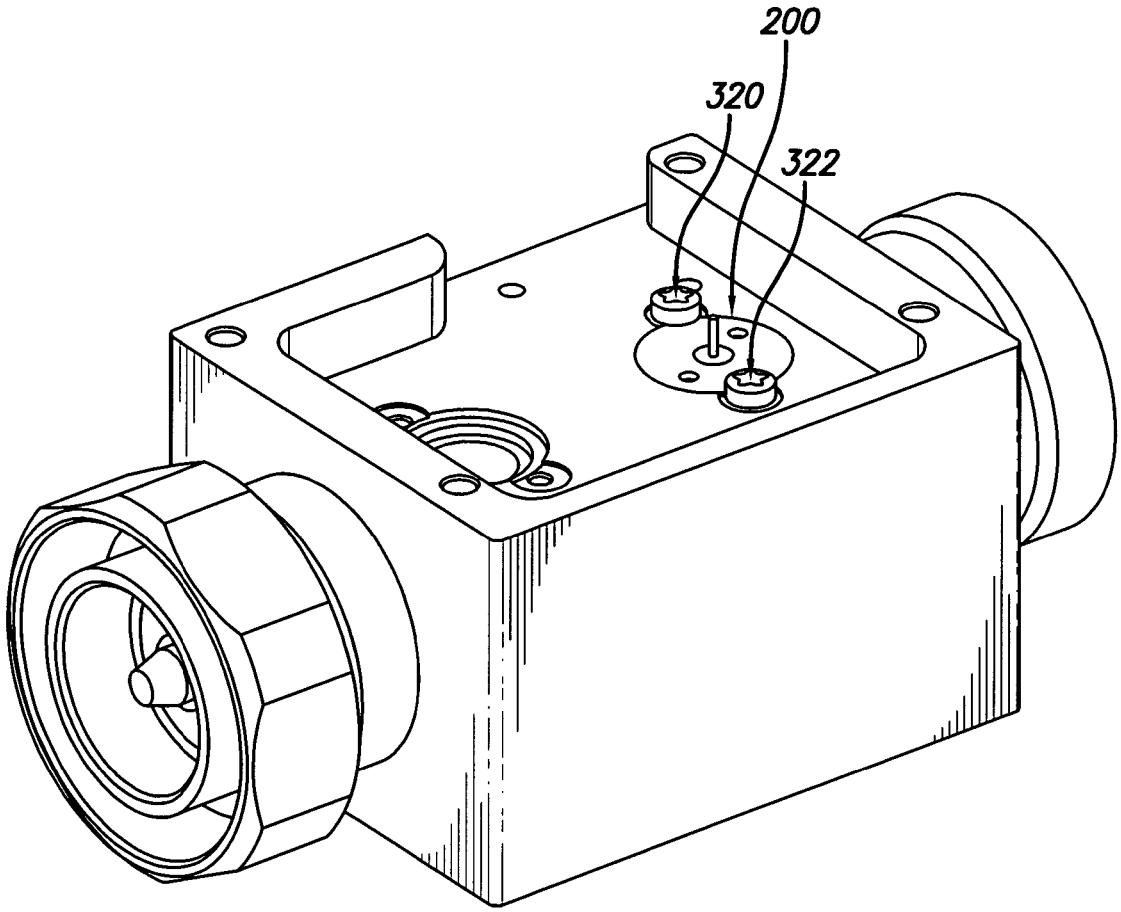
Figure 7A:
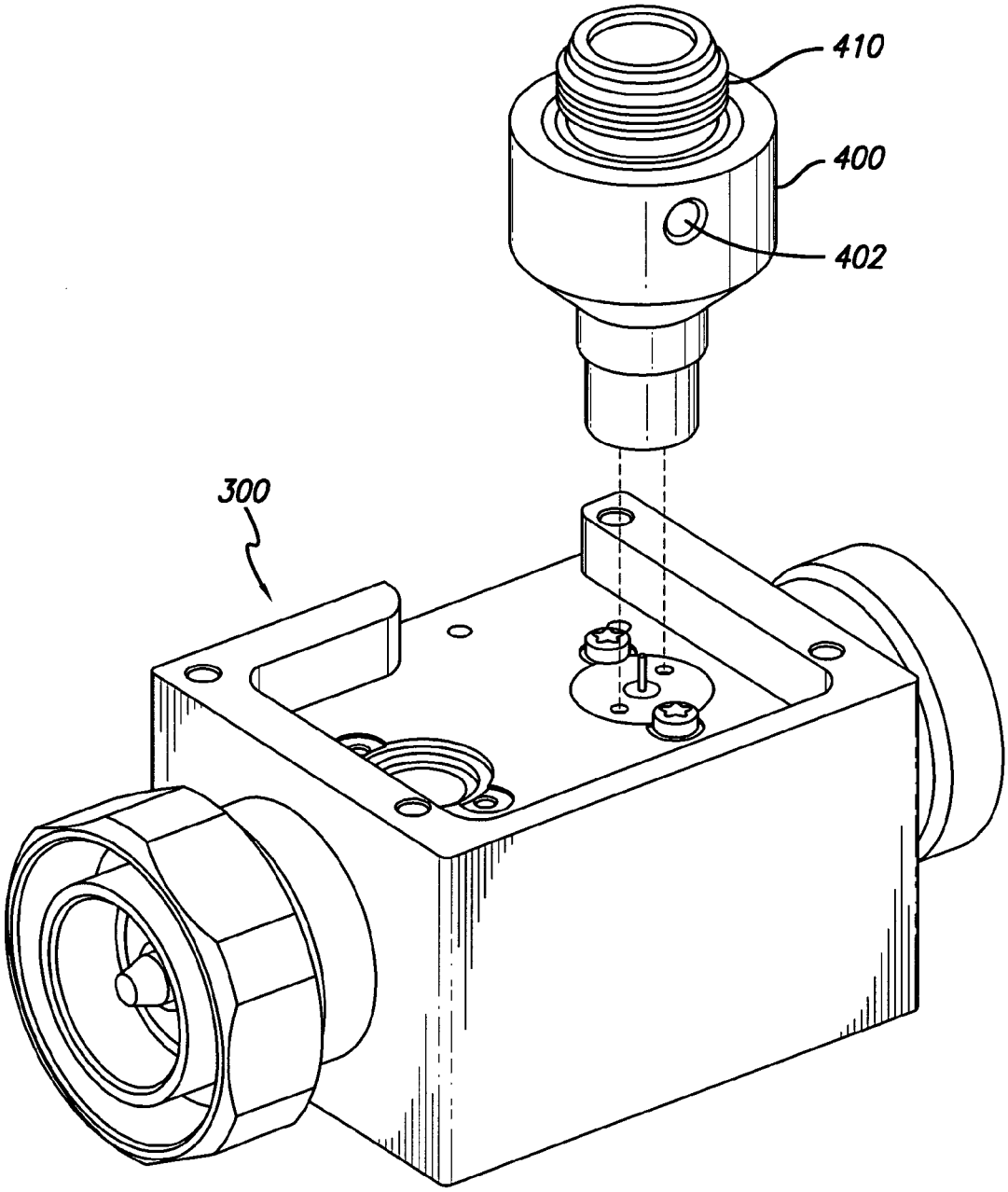
FIGS. 7A and 7B are top perspective views of the coupler assembly of the present invention being assembled in a coupler fixture and tuned using the directivity test fixture in accordance with a preferred embodiment.

As shown in FIGS. 5A and 5B, the coupler assembly 200 is simply dropped loop down on the opening bore 312 of a coupler fixture 300 to sample power flowing through the fixture with a selectable coupling and directivity tunable using a test fixture. An example of adjustment of the coupler 200 in a coupler fixture with a test fixture 400 is shown in FIGS. 7A and B. The inner diameter of the bore 312 is preferably smaller, e.g., 0.040-in (1 mm) smaller, than the outer diameter which keeps the disk assembly at a fixed position and provides isolation from the main transmission line. A second bore 310 may receive another coupler assembly 200 or any other coupler for the specific application.

Figure 2:
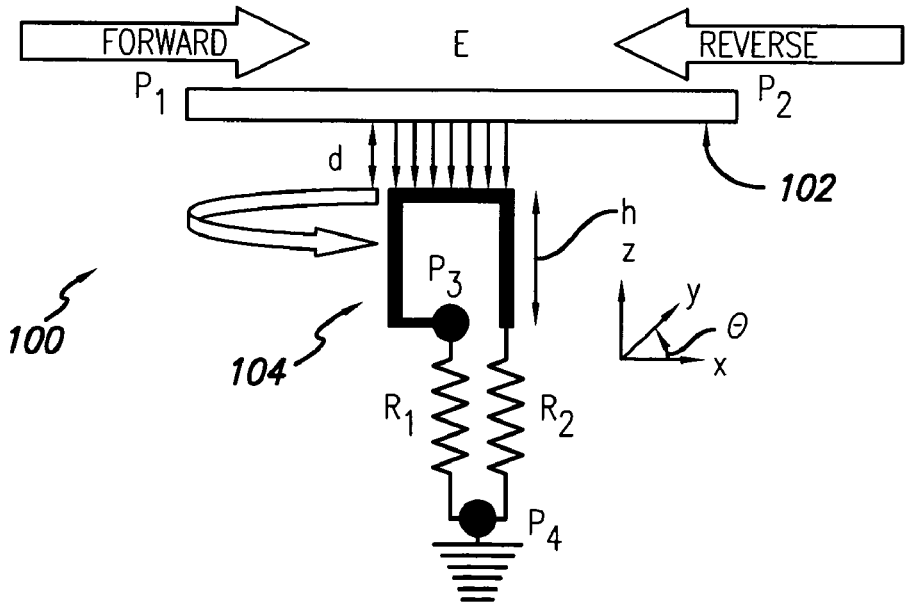
FIG. 2 is an equivalent circuit diagram of the improved coupler of the present invention.

With reference to an equivalent circuit diagram 100 of FIG. 2 the adjustable sampling of the microwave power E flowing from port P1 to port P2 along path 102 may be appreciated. The present invention provides convenient adjustment of both coupling and directivity. The coupling can be adjusted three different ways:

(a) by adjusting bore step depth or (b) by changing the loop 104 height, h or (c) by moving the disk assembly further away or closer from the main transmission line 102.

The coupling is done through the loop which can be fabricated inexpensively using photo etching or stamping techniques as in the preferred embodiment 206 (best shown in FIGS. 3 and 4). Point $P_3$ in FIG. 2 can move in the z-direction but it is stationary in the x and y directions. The loop is rotated with $P_3$ as the pivotal point. The coupled port can have just a pin output (e.g., 204 in FIG. 3) which can be soldered to a circuit board after adjusting the coupler using a field-replaceable SMA connector. A special fixture 400 with MCX female connector 412 inserted is shown in FIG. 6 and FIG. 7.

Figure 6A:
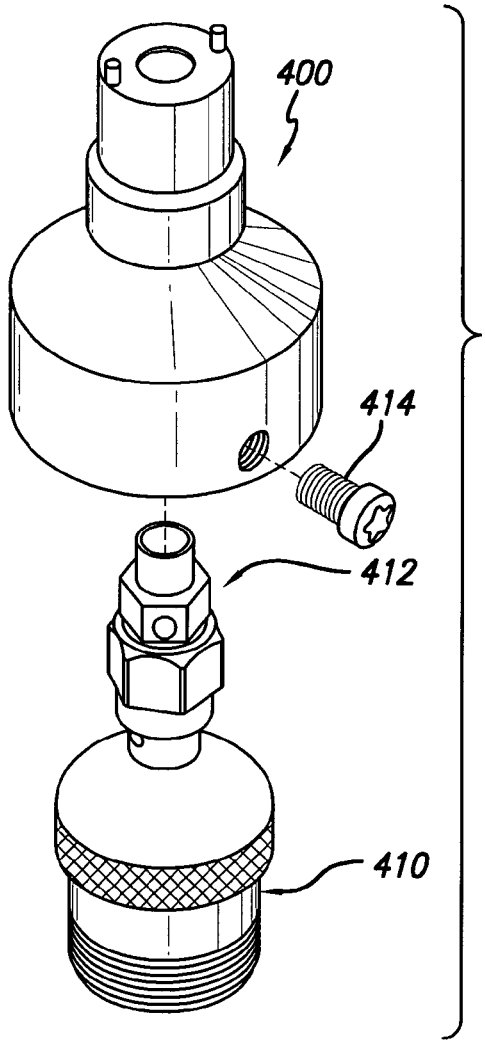
FIGS. 6A and 6B are top perspective views of a directivity test fixture and connector in accordance with a preferred embodiment.
Figure 6B:
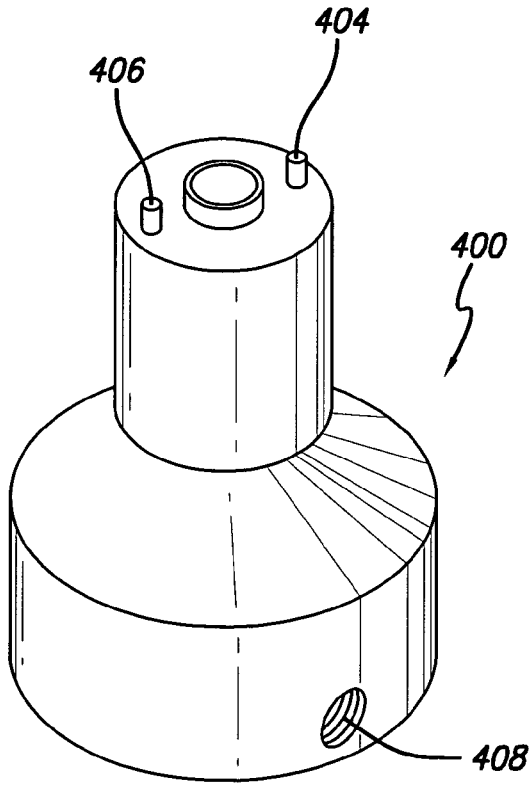
Figure 7B:
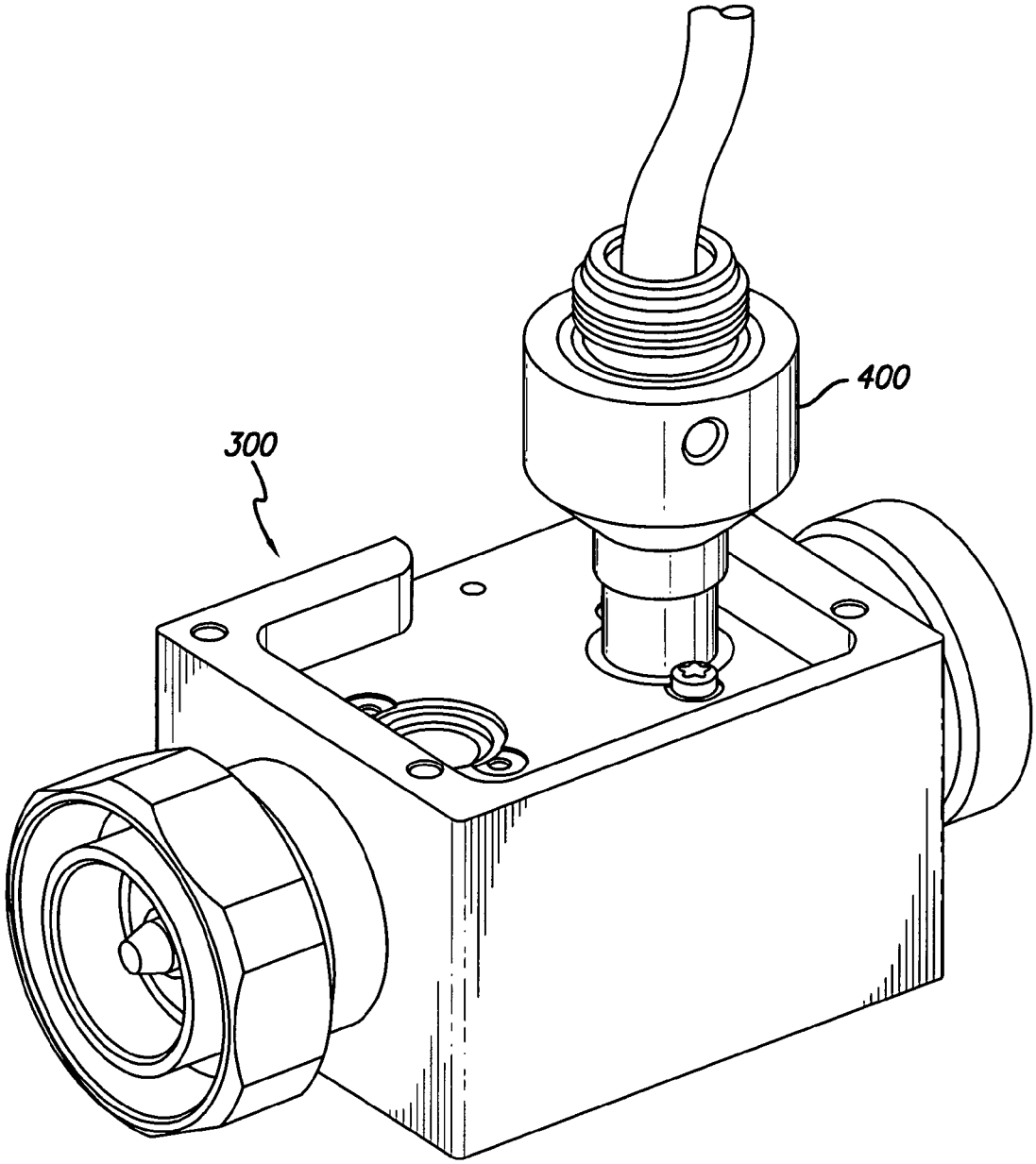

When the loop is moved closer to the rod 102, the coupling increases and when it is moved away from the rod, the coupling decreases. If we define the distance separating the main rod and the side of the loop parallel to the transmission line (coupling surface), d, the coupling increases as d is decreased. At a given distance, d, strongest coupling occurs when the coupling surface is parallel with the main line. The directivity is tuned by rotating the coupler assembly 200. This is preferably provided by engaging two holes 214, 216 in circuit board 202 (FIG. 4) with matching pins 404, 406 in test fixture 400 (FIG. 6B). If the angle the coupling surface makes with the main line is θ, then the maximum coupling occurs when θ=0, i.e. the coupling surface is parallel to the main line. However, this is not the position where the best directivity is achieved. The best directivity occurs approximately when $\theta=\pm\phi$ degrees. The value of ϕ is different for different frequency bands. At Cellular frequencies a usually observed value of ϕ is approximately 15°. At a given vertical position, as |θ| gets further away from zero but is less than 90°, the coupling will decrease. However, the change in coupling per degree of rotation is much smaller than the change in directivity. When |θ| exceeds 90°, the direction of the coupler is reversed, i.e. the forward coupler becomes the reverse coupler or vice versa. The actual power sampled by the coupler 200 at different settings is measured using the standard connector 412 and cable 410 (FIGS. 6A and 7B). The standard connector 412 may be simply mounted to the custom fixture 400 using set screws 414 and openings 402, 408.

When the coupler is tuned for a specific forward coupling and the best achievable directivity, the superposition of the forward and reverse travelling waves at $P_3$ add in phase. However, when power is applied in $P_2$, the forward and reverse travelling waves are out of phase so no power flows to $P_3$. By rotating the coupling surface, we change the phase until the signal cancellation occurs at $P_3$. As shown in FIG. 5B, once the desired amount of coupling and directivity are obtained simultaneously, the coupler assembly 200 can be locked down with screws 320, 322 engaging the top edges of the disk shaped board 202 and screwing into threaded openings 324, 326 (FIG. 5A).

Accordingly, the present invention also provides an improved method of directivity tuning and assembly of a coupling fixture assembly. In particular, top mounting via screws 320, 322 avoids specific fixture designs with side openings as in barrel couplers on the prior "P" coupler design. Also the test fixture 400 provides convenient power monitoring while adjusting for desired directivity.

Figure 8A:
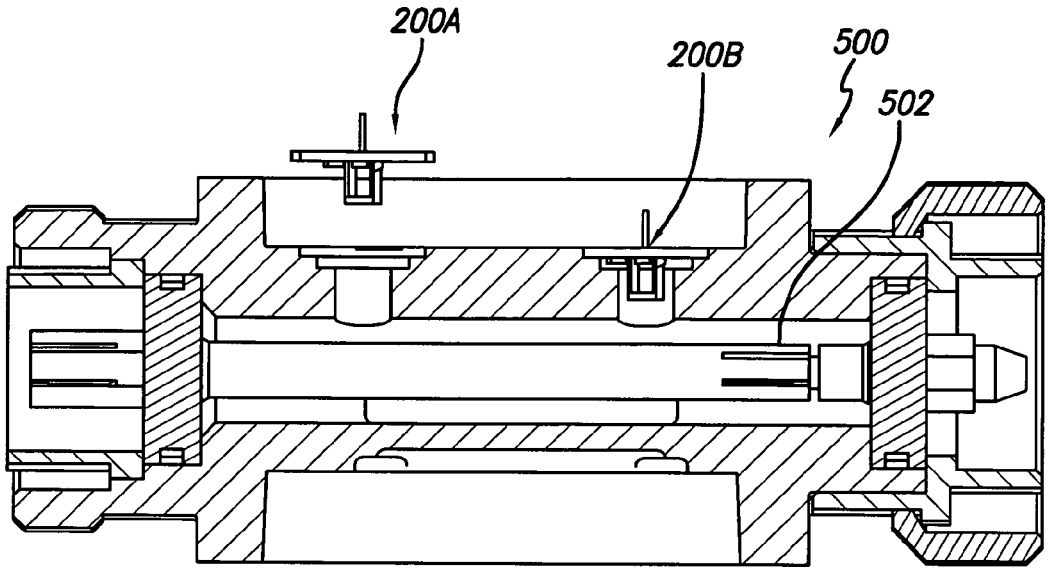
FIGS. 8A and 8B are side sectional views of two coupler assemblies of the present invention assembled in a four port coupler fixture in accordance with a preferred embodiment.
Figure 8B:
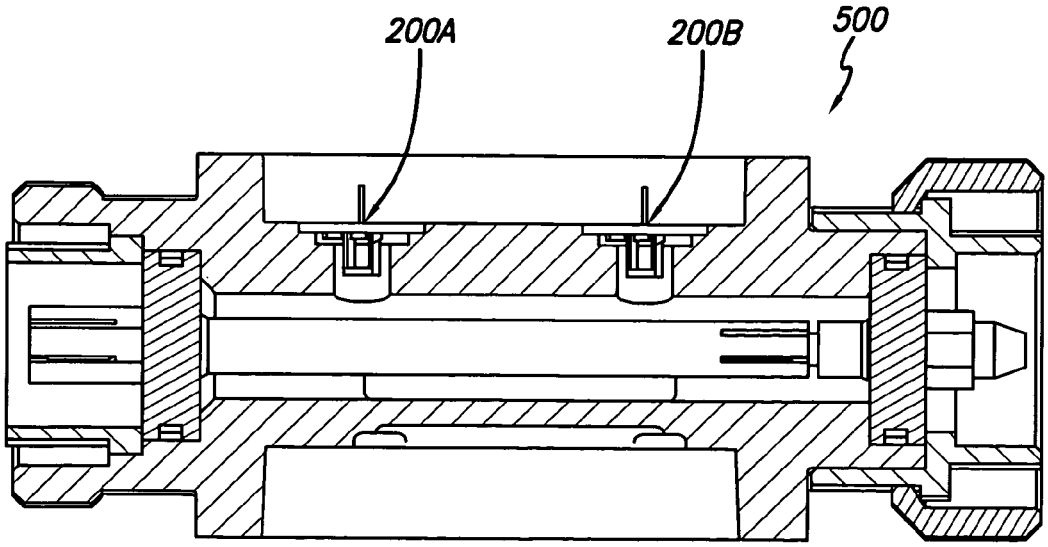

Referring to FIG. 8, an embodiment of a four port coupler fixture 500 employing two coupler assemblies 200 is illustrated. The two adjustable coupler assemblies 200A and 200B may be mounted in the respective bores to couple selectively to power in rod 502 by adjusting each coupler 200 as described above. This can provide desired coupling to these two ports using the above described theory of operation.

In view of the foregoing it will be appreciated that the present invention provides an improved "P" coupler with size, cost and manufacturability advantages over prior couplers of this type. Furthermore the present invention provides an improved test fixture and an improved method of adjusting a coupler for desired coupling to power flow in a coupling fixture.

The present invention has been described in relation to presently preferred embodiments, however, these should not be viewed as limiting in nature.

What is claimed is:

1. A microwave coupler assembly, comprising:

a rotatable disk shaped circuit board having first and second major surfaces coated with conductive material, the first and second surfaces respectively having first and second regions of exposed dielectric material without conductive material thereon;

a conductive coupling loop mounted to the first surface of the circuit board in said first region and oriented away from the surface;

first and second resistors connecting the coupling loop to the first conductive surface of the circuit board; and an RF connector electrically connected to the coupling loop and extending from the second surface of the circuit board in said second region.

2. A microwave coupler assembly as set out in claim 1, wherein said conductive coupling loop is generally U shaped.

3. A microwave coupler assembly as set out in claim 1, wherein said circuit board has first and second openings for receiving pins from a test fixture.

4. A microwave coupler assembly as set out in claim 2, wherein said first and second resistors are electrically connected to opposite ends of said U shaped conductive coupling loop and to said conductive first surface of said circuit board.

5. A combined microwave test fixture and directional coupler assembly, comprising:

a directional coupler assembly comprising a coupler fixture housing having an input port, a through port, a coupled port, and a decoupled port, an adjustable coupler structure mounted in a bore of the coupled port of the housing, the coupler structure comprising a conductive rotatable disk shaped circuit board, a conductive coupling loop mounted to the circuit board at a dielectric portion thereof and oriented into the bore of the housing, first and second resistors electrically connecting the coupling loop to the circuit board, a RF connector electrically connected to the coupling loop and also extending from the opposite side of the circuit board from the coupling loop, and a test fixture mating connector on the circuit board; and a test fixture assembly comprising a directivity adjustment connector adapted to mate with the test fixture mating connector on the circuit board and an RF connector adapted to mate with the RF connector on the circuit board;

wherein the disk is adjustable by turning the test fixture to rotate the disk shaped circuit board and change the direction of the loop in the housing and alter the directivity of the coupling of said coupled port.

6. A microwave test fixture and directional coupler assembly as set out in claim 5, wherein said test fixture mating connector comprises first and second holes in the circuit board and wherein said directivity adjustment connector of said test fixture comprises matching mating pins.

7. A microwave test fixture and directional coupler assembly as set out in claim 5, wherein said test fixture assembly comprises a housing having first and second screws and threaded holes in the housing and an inner opening receiving the RF connector and, wherein the RF connector is locked in place in the housing by engaging it by the set screws.

8. A microwave test fixture and directional coupler assembly as set out in claim 5, wherein the coupler fixture housing includes an inner cavity, wherein a through coupler is configured within the cavity between the input and coupled ports.

9. A microwave test fixture and directional coupler assembly as set out in claim 5, wherein the coupled port is measurable at different loop orientations from the RF connector of the test fixture assembly.

10. A microwave test fixture and directional coupler assembly as set out in claim 5, further comprising a second coupler structure configured in a second bore in said coupler fixture housing.

11. A method of adjusting a microwave directional coupler assembly, comprising:

inserting a coupler assembly comprising a disk shaped circuit board, a conductive loop and RF connector in a bore in a coupler housing;

rotating the disk shaped circuit board using a separate test fixture adapted to mate with the disk shaped circuit board;

measuring RF power using a connector configured in the test fixture;

locking the disk shaped circuit board in place using set screws engaging the top edge of the circuit board and holes in the housing; and removing the test fixture.

* * * * *